US006899181B2

(12) United States Patent
Simpson et al.

(10) Patent No.: US 6,899,181 B2
(45) Date of Patent: May 31, 2005

(54) METHODS AND APPARATUS FOR EXPANDING A TUBULAR WITHIN ANOTHER TUBULAR

(75) Inventors: Neil A. A. Simpson, Aberdeen (GB); Kevin O. Trahan, Calgary (CA)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/348,617

(22) Filed: Jan. 22, 2003

(65) Prior Publication Data

US 2003/0106698 A1 Jun. 12, 2003

Related U.S. Application Data

(60) Division of application No. 09/712,789, filed on Nov. 13, 2000, now Pat. No. 6,598,678, which is a continuation-in-part of application No. 09/470,176, filed on Dec. 22, 1999, now Pat. No. 6,446,323, and a continuation-in-part of application No. 09/469,692, filed on Dec. 22, 1999, now Pat. No. 6,325,148.

(51) Int. Cl.[7] ..... E21B 23/02
(52) U.S. Cl. ..... 166/380; 166/384; 166/207
(58) Field of Search ..... 166/380, 384, 166/207

(56) References Cited

U.S. PATENT DOCUMENTS

| | | | |
|---|---|---|---|
| 761,518 | A | 5/1904 | Lykken |
| 988,054 | A | 3/1911 | Wiet |
| 1,233,888 | A | 7/1917 | Leonard |
| 1,301,285 | A | 4/1919 | Leonard |
| 1,324,303 | A | 12/1919 | Carmichael |
| 1,358,818 | A | 11/1920 | Bering |
| 1,545,039 | A | 7/1925 | Deavers |
| 1,561,418 | A | 11/1925 | Duda |
| 1,569,729 | A | 1/1926 | Duda |
| 1,597,212 | A | 8/1926 | Spengler |
| 1,739,932 | A | 12/1929 | Ventresca |

(Continued)

FOREIGN PATENT DOCUMENTS

| | | | |
|---|---|---|---|
| DE | 225326 | 9/1910 | |
| DE | 3213464 A1 | 10/1983 | ..... B23D/45/12 |
| DE | 4133802 C1 | 10/1991 | ..... F16L/9/12 |

(Continued)

OTHER PUBLICATIONS

"Expandable Slotted Tubes Offer Well Design Benefits", Metcalfe, P., Petroline Wireline Services Ltd., Hart's Petroleum Engineer International, Oct. 1996, pp. 60–63.

*Hanging Liners By Pipe Expansion*, U.S. Appl. No. 09/847,973, filed May 3, 2001.

U.S. Appl. No. 09/469,643.

*Primary Examiner*—William Neuder
(74) *Attorney, Agent, or Firm*—Moser, Patterson & Sheridan, L.L.P.

(57) ABSTRACT

The present invention provides methods and apparatus for cutting tubulars in a wellbore. In one aspect of the invention, a cutting tool having radially disposed rolling element cutters is provided for insertion into a wellbore to a predetermined depth where a tubular therearound will be cut into an upper and lower portion. The cutting tool is constructed and arranged to be rotated while the actuated cutters exert a force on the inside wall of the tubular, thereby severing the tubular therearound. In one aspect, the apparatus is run into the well on wireline which is capable of bearing the weight of the apparatus while supplying a source of electrical power to at least one downhole motor which operates at least one hydraulic pump. The hydraulic pump operates a slip assembly to fix the downhole apparatus within the wellbore prior to operation of the cutting tool. Thereafter, the pump operates a downhole motor to rotate the cutting tool while the cutters are actuated.

14 Claims, 15 Drawing Sheets

U.S. PATENT DOCUMENTS

| | | | | |
|---|---|---|---|---|
| 1,750,627 | A | 3/1930 | Crum | |
| 1,809,988 | A | 6/1931 | Raymond | |
| 1,880,218 | A | 10/1932 | Simmons | |
| 1,930,825 | A | 10/1933 | Raymond | 153/81 |
| 1,952,652 | A | 3/1934 | Brannon | 81/194 |
| 1,981,525 | A | 11/1934 | Price | 166/4 |
| 2,017,451 | A | 10/1935 | Wickersham | 166/10 |
| 2,214,226 | A | 9/1940 | English | 166/1 |
| 2,216,226 | A | 10/1940 | Bumpous | |
| 2,383,214 | A | 8/1945 | Prout | 153/82 |
| 2,424,878 | A | 7/1947 | Crook | 154/82 |
| 2,499,630 | A | 3/1950 | Clark | 153/81 |
| 2,519,116 | A | 8/1950 | Crake | 166/10 |
| 2,627,891 | A | 2/1953 | Clark | 153/82 |
| 2,633,374 | A | 3/1953 | Boice | 285/118 |
| 2,663,073 | A | 12/1953 | Bieber et al. | 29/148 |
| 2,695,449 | A | 11/1954 | Chauvin | 30/107 |
| 2,754,577 | A | 7/1956 | Maxwell | |
| 2,898,971 | A | 8/1959 | Hempel | 153/82 |
| 3,028,915 | A | 4/1962 | Jennings | 166/16 |
| 3,039,530 | A | 6/1962 | Condra | 166/55 |
| 3,087,546 | A | 4/1963 | Wooley | 166/46 |
| 3,167,122 | A | 1/1965 | Lang | 166/14 |
| 3,179,168 | A | 4/1965 | Vincent | 166/14 |
| 3,186,485 | A | 6/1965 | Owen | 166/63 |
| 3,188,850 | A | 6/1965 | Linthicum et al. | |
| 3,191,677 | A | 6/1965 | Kinley | 166/14 |
| 3,191,680 | A | 6/1965 | Vincent | 166/46 |
| 3,195,646 | A | 7/1965 | Brown | 166/208 |
| 3,203,451 | A | 8/1965 | Vincent | 138/143 |
| 3,203,483 | A | 8/1965 | Vincent | 166/207 |
| 3,245,471 | A | 4/1966 | Howard | 166/46 |
| 3,297,092 | A | 1/1967 | Jennings | 166/207 |
| 3,326,293 | A | 6/1967 | Skipper | 166/150 |
| 3,353,599 | A | 11/1967 | Swift | 166/15 |
| 3,354,955 | A | 11/1967 | Berry | 166/14 |
| 3,467,180 | A | 9/1969 | Pensotti | 165/180 |
| 3,477,506 | A | 11/1969 | Malone | 166/207 |
| 3,489,220 | A | 1/1970 | Kinley | 166/277 |
| 3,498,376 | A | 3/1970 | Sizer et al. | 166/120 |
| 3,583,200 | A | 6/1971 | Cvijanovic et al. | 72/393 |
| 3,669,190 | A | 6/1972 | Sizer et al. | 166/315 |
| 3,689,113 | A | 9/1972 | Blaschke | 285/90 |
| 3,691,624 | A | 9/1972 | Kinley | 29/523 |
| 3,712,376 | A | 1/1973 | Owen et al. | 166/277 |
| 3,746,091 | A | 7/1973 | Owen et al. | 166/207 |
| 3,776,307 | A | 12/1973 | Young | 166/125 |
| 3,780,562 | A | 12/1973 | Kinley | 72/479 |
| 3,785,193 | A | 1/1974 | Kinley et al. | 72/393 |
| 3,818,734 | A | 6/1974 | Bateman | 72/75 |
| 3,820,370 | A | 6/1974 | Duffy | 72/75 |
| 3,911,707 | A | 10/1975 | Minakov et al. | 72/76 |
| 3,948,321 | A | 4/1976 | Owen et al. | 166/277 |
| 3,977,076 | A | 8/1976 | Vieira et al. | 30/103 |
| 4,069,573 | A | 1/1978 | Rogers, Jr. et al. | 29/421 R |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,311,194 | A | 1/1982 | White | |
| 4,319,393 | A | 3/1982 | Pogonowski | 29/434 |
| 4,324,407 | A | 4/1982 | Upham et al. | 277/27 |
| 4,349,050 | A | 9/1982 | Bergstrom et al. | 138/147 |
| 4,359,889 | A | 11/1982 | Kelly | 72/62 |
| 4,362,324 | A | 12/1982 | Kelly | 285/119 |
| 4,371,199 | A | 2/1983 | Kushner et al. | |
| 4,382,379 | A | 5/1983 | Kelly | 73/46 |
| 4,387,502 | A | 6/1983 | Dom | 29/568 |
| 4,389,765 | A | 6/1983 | Thompson, Jr. | 29/426.5 |
| 4,393,931 | A | 7/1983 | Muse et al. | |
| 4,407,150 | A | 10/1983 | Kelly | 72/61 |
| 4,414,739 | A | 11/1983 | Kelly | 29/727 |
| 4,429,620 | A | 2/1984 | Burkhardt et al. | 91/395 |
| 4,445,201 | A | 4/1984 | Pricer | 365/154 |
| 4,450,612 | A | 5/1984 | Kelly | 72/62 |
| 4,470,280 | A | 9/1984 | Kelly | 72/61 |
| 4,483,399 | A | 11/1984 | Colgate | 166/308 |
| 4,487,630 | A | 12/1984 | Crook et al. | 75/123 B |
| 4,502,308 | A | 3/1985 | Kelly | 72/58 |
| 4,505,142 | A | 3/1985 | Kelly | 72/54 |
| 4,505,612 | A | 3/1985 | Shelley, Jr. | 405/101 |
| 4,531,581 | A | 7/1985 | Pringle et al. | 166/120 |
| 4,567,631 | A | 2/1986 | Kelly | 29/157.3 C |
| 4,581,617 | A | 4/1986 | Yoshimoto et al. | 346/108 |
| 4,588,030 | A | 5/1986 | Blizzard | 166/120 |
| 4,626,129 | A | 12/1986 | Kothmann et al. | 405/43 |
| 4,697,640 | A | 10/1987 | Szarka | 166/120 |
| 4,807,704 | A | 2/1989 | Hsu et al. | 166/313 |
| 4,848,462 | A | 7/1989 | Allwin | |
| 4,848,469 | A | 7/1989 | Baugh et al. | 166/382 |
| 4,862,966 | A | 9/1989 | Lindsey et al. | |
| 4,866,966 | A | 9/1989 | Hagen | 72/75 |
| 4,883,121 | A | 11/1989 | Zwart | 166/217 |
| 4,976,322 | A | 12/1990 | Abdrakhmanov et al. | 175/57 |
| 4,997,320 | A | 3/1991 | Hwang et al. | 408/22 |
| 5,014,779 | A | 5/1991 | Meling et al. | 166/55.7 |
| 5,048,612 | A | 9/1991 | Cochran | |
| 5,052,483 | A | 10/1991 | Hudson | 166/55 |
| 5,052,849 | A | 10/1991 | Zwart | 403/300 |
| 5,086,845 | A | 2/1992 | Baugh | |
| 5,156,209 | A | 10/1992 | McHardy | 166/324 |
| 5,181,570 | A | 1/1993 | Allwin et al. | |
| 5,184,687 | A | 2/1993 | Abdrakhmanov et al. | 175/267 |
| 5,201,817 | A | 4/1993 | Hailey | 175/269 |
| 5,267,613 | A | 12/1993 | Zwart et al. | 166/178 |
| 5,271,472 | A | 12/1993 | Leturno | 175/107 |
| 5,301,760 | A | 4/1994 | Graham | 175/61 |
| 5,307,879 | A | 5/1994 | Kent | 166/382 |
| 5,322,127 | A | 6/1994 | McNair et al. | 166/313 |
| 5,348,095 | A | 9/1994 | Worrall et al. | 166/380 |
| 5,366,012 | A | 11/1994 | Lohbeck | 166/277 |
| 5,409,059 | A | 4/1995 | McHardy | 166/208 |
| 5,435,400 | A | 7/1995 | Smith | 175/61 |
| 5,467,826 | A | 11/1995 | Miller | |
| 5,472,057 | A | 12/1995 | Winfree | 175/57 |
| 5,494,106 | A | 2/1996 | Gueguen et al. | |
| 5,520,255 | A | 5/1996 | Barr et al. | 175/24 |
| 5,553,679 | A | 9/1996 | Thorp | 175/73 |
| 5,560,426 | A | 10/1996 | Trahan et al. | 166/120 |
| 5,636,661 | A | 6/1997 | Moyes | 137/614.2 |
| 5,667,011 | A | 9/1997 | Gill et al. | 166/295 |
| 5,685,369 | A | 11/1997 | Ellis et al. | 166/195 |
| 5,706,905 | A | 1/1998 | Barr | 175/61 |
| 5,785,120 | A | 7/1998 | Smalley et al. | 166/55 |
| 5,787,984 | A | 8/1998 | Mabile | 166/277 |
| 5,887,668 | A | 3/1999 | Haugen et al. | 175/79 |
| 5,901,787 | A | 5/1999 | Boyle | 166/135 |
| 5,901,789 | A | 5/1999 | Donnelly et al. | 166/381 |
| 5,918,677 | A | 7/1999 | Head | |
| 5,924,745 | A | 7/1999 | Campbell | 285/90 |
| 5,960,895 | A | 10/1999 | Chevallier et al. | 175/27 |
| 5,979,571 | A | 11/1999 | Scott et al. | 175/61 |
| 6,021,850 | A | 2/2000 | Wood et al. | 166/380 |
| 6,029,748 | A | 2/2000 | Forsyth et al. | 166/380 |
| 6,065,536 | A | 5/2000 | Gudmestad et al. | |
| 6,070,671 | A | 6/2000 | Cumming et al. | 166/381 |
| 6,073,692 | A | 6/2000 | Wood et al. | |
| 6,098,717 | A | 8/2000 | Bailey et al. | 166/382 |
| 6,325,148 | B1 | 12/2001 | Trahan et al. | |
| 6,354,373 | B1 | 3/2002 | Vercaemer et al. | 166/277 |
| 6,425,444 | B1 | 7/2002 | Metcalfe et al. | 166/387 |
| 6,446,323 | B1 | 9/2002 | Metcalfe | |

| | | | | | |
|---|---|---|---|---|---|
| 6,446,724 | B2 | | 9/2002 | Baugh et al. | 166/285 |
| 6,454,013 | B1 | | 9/2002 | Metcalfe | |
| 6,457,532 | B1 | | 10/2002 | Simpson | 166/380 |
| 6,571,672 | B1 | | 6/2003 | Rudd | |
| 6,631,759 | B2 | * | 10/2003 | Cook et al. | 166/217 |
| 6,648,075 | B2 | | 11/2003 | Badrak et al. | |
| 2001/0020532 | A1 | | 9/2001 | Baugh | |
| 2001/0040054 | A1 | | 11/2001 | Haugen et al. | |
| 2002/0139540 | A1 | | 10/2002 | Lauritzen | 166/387 |
| 2002/0145281 | A1 | * | 10/2002 | Metcalfe et al. | 285/206 |
| 2002/0166668 | A1 | * | 11/2002 | Metcalfe et al. | 166/378 |
| 2003/0085041 | A1 | * | 5/2003 | Maguire et al. | 166/380 |
| 2003/0136561 | A1 | * | 7/2003 | Metcalfe et al. | 166/277 |

FOREIGN PATENT DOCUMENTS

| | | | | |
|---|---|---|---|---|
| EP | 0952305 | A1 | 10/1999 | E21B/43/10 |
| EP | 0961007 | A2 | 12/1999 | E21B/33/10 |
| EP | 1 242 714 | A1 | 9/2002 | E21B/23/00 |
| GB | 14073 | | 6/1904 | |
| GB | 730338 | | 5/1955 | |
| GB | 792886 | | 4/1958 | |
| GB | 997721 | | 9/1965 | |
| GB | 1277461 | | 6/1972 | B21D/39/04 |
| GB | 1448304 | | 2/1976 | E21B/33/13 |
| GB | 1457843 | | 12/1976 | B21D/39/10 |
| GB | 1582392 | | 1/1981 | B21D/39/10 |
| GB | 2216926 | A | 10/1989 | E21B/7/20 |
| GB | 2313860 | B | 12/1997 | E21B/10/34 |
| GB | 2320734 | | 7/1998 | E21B/33/127 |
| GB | 2329918 | A | 4/1999 | E21B/43/10 |
| GB | 2347445 | A | 9/2000 | E21B/7/20 |
| GB | 2350137 | | 11/2000 | E21B/43/10 |
| RU | 976019 | A1 | 5/1991 | E21B/29/00 |
| WO | WO 92/01139 | | 1/1992 | E21B/17/08 |
| WO | WO 93/24728 | | 12/1993 | E21B/17/10 |
| WO | WO 93/25800 | | 12/1993 | E21B/43/10 |
| WO | WO 94/25655 | | 11/1994 | D04C/1/06 |
| WO | WO 97/21901 | | 6/1997 | E21B/17/08 |
| WO | WO 98/00626 | | 1/1998 | E21B/43/10 |
| WO | WO 99/02818 | | 1/1999 | E21B/43/10 |
| WO | WO 99/18328 | | 4/1999 | E21B/23/01 |
| WO | WO 99/23354 | | 5/1999 | E21B/43/10 |
| WO | WO 00/37766 | | 6/2000 | E21B/29/00 |
| WO | WO 00/37767 | | 6/2000 | E21B/29/00 |
| WO | WO 00/37771 | | 6/2000 | E21B/43/10 |
| WO | 01/83943 | | 6/2000 | E21B/29/00 |
| WO | WO 01/60545 | | 8/2001 | B21D/39/00 |
| WO | 02/38343 | A2 | 5/2002 | |

* cited by examiner

METHODS AND APPARATUS FOR EXPANDING A TUBULAR WITHIN ANOTHER TUBULAR

CROSS-REFERENCE TO RELATED APPLICATIONS

This application is a divisional of U.S. patent application Ser. No. 09/712,789, filed Nov. 13, 2000, now U.S. Pat. No. 6,598,678, which is a Continuation-in-Part Application based upon U.S. patent application Ser. No. 09/470,176, which was filed on Dec. 22, 1999, now U.S. Pat. No. 6,446,323 and upon U.S. patent application Ser. No. 09/469,692, which was filed Dec. 22, 1999, now U.S. Pat. No. 6,325,148. Each of the aforementioned related patent applications is herein incorporated by reference.

BACKGROUND OF THE INVENTION

1. Field of the Invention

The present invention relates to methods and apparatus for separating and joining tubulars in a wellbore; more particularly, the present invention relates to cutting a tubular in a wellbore using rotational and radial forces brought to bear against a wall of the tubular.

2. Description of the Related Art

In the completion and operation of hydrocarbon wells, it is often necessary to separate one piece of a downhole tubular from another piece in a wellbore. In most instances, bringing the tubular back to surface for a cutting operation is impossible and in all instances it is much more efficient in time and money to separate the pieces in the wellbore. The need to separate tubulars in a wellbore arises in different ways. For example, during drilling and completion of an oil well, tubulars and downhole tools mounted thereon are routinely inserted and removed from the wellbore. In some instances, tools or tubular strings become stuck in the wellbore leading to a "fishing" operation to locate and remove the stuck portion of the apparatus. In these instances, it is often necessary to cut the tubular in the wellbore to remove the run-in string and subsequently remove the tool itself by milling or other means. In another example, a downhole tool such as a packer is run into a wellbore on a run-in string of tubular. The packing member includes a section of tubular or a "tail pipe" hanging from the bottom thereof and it is advantageous to remove this section of tail pipe in the wellbore after the packer has been actuated. In instances where workover is necessary for a well which has slowed or ceased production, downhole tubulars routinely must be removed in order to replace them with new or different tubulars or devices. For example, un-cemented well casing may be removed from a well in order to reuse the casing or to get it out of the way in a producing well.

In yet another example, plug and abandonment methods require tubulars to be cut in a wellbore such as a subsea wellbore in order to seal the well and conform with rules and regulations associated with operation of an oil well offshore. Because the interior of a tubular typically provides a pathway clear of obstructions, and because any annular space around a tubular is limited, prior art devices for downhole tubular cutting typically operate within the interior of the tubular and cut the wall of the tubular from the inside towards the outside.

A prior art example of an apparatus designed to cut a tubular in this fashion includes a cutter run into the interior of a tubular on a run-in string. As the tool reaches a predetermined area of the wellbore where the tubular will be separated, cutting members in the cutting tool are actuated hydraulically and swing outwards from a pivot point on the body of the tool. When the cutting members are actuated, the run-in string with the tool therebelow is rotated and the tubular therearound is cut by the rotation of the cutting members. The foregoing apparatus has some disadvantages. For instance, the knives are constructed to swing outward from a pivot point on the body of the cutting tool and in certain instances, the knives can become jammed between the cutting tool and the interior of the tubular to be cut. In other instances, the cutting members can become jammed in a manner which prevents them from retracting once the cutting operation is complete. In still other examples, the swinging cutting members can become jammed with the lower portion of tubular after it has been separated from the upper portion thereof. Additionally, this type of cutter creates cuttings that are difficult to remove and subsequently causes problems for other downhole tools.

An additional problem associated conventional downhole cutting tools includes the cost and time associated with transporting a run-in string of tubular to a well where a downhole tubular is to be cut. Run-in strings for the cutting tools are expensive, must be long enough to reach that section of downhole tubular to be cut, and require some type of rig in order to transport, bear the weight of, and rotate the cutting tool in the wellbore. Because the oil wells requiring these services are often remotely located, transporting this quantity of equipment to a remote location is expensive and time consuming. While coil tubing has been utilized as a run-in string for downhole cutters, there is still a need to transport the bulky reel of coil tubing to the well site prior to performing the cutting operation.

Other conventional methods and apparatus for cutting tubulars in a wellbore rely upon wireline to transport the cutting tool into the wellbore. However, in these instances the actual separation of the downhole tubular is performed by explosives or chemicals, not by a rotating cutting member. While the use of wireline in these methods avoids time and expense associated with run-in strings of tubulars or coil tubing, chemicals and explosives are dangerous, difficult to transport and the result of their use in a downhole environment is always uncertain.

There is a need therefore, for a method and apparatus for separating downhole tubulars which is more effective and reliable than conventional, downhole cutters. There is yet a further need for an effective method and apparatus for separating downhole tubulars which does not rely upon a run-in string of tubular or coil tubing to transport the cutting member into the wellbore. There is yet a further need for a method and apparatus of separating downhole tubulars which does not rely on explosives or chemicals. There is a yet a further need for methods and apparatus for connecting a first tubular to a second tubular downhole while ensuring a strong connection therebetween.

SUMMARY OF THE INVENTION

The present invention provides methods and apparatus for cutting tubulars in a wellbore. In one aspect of the invention, a cutting tool having radially disposed rolling element cutters is provided for insertion into a wellbore to a predetermined depth where a tubular therearound will be cut into an upper and lower portion. The cutting tool is constructed and arranged to be rotated while the actuated cutters exert a force on the inside wall of the tubular, thereby severing the tubular therearound. In one aspect, the apparatus is run into the well on wireline which is capable of bearing the weight of the apparatus while supplying a source of electrical power to at least one downhole motor which operates at least one hydraulic pump. The hydraulic pump operates a slip assembly to fix the downhole apparatus within the wellbore prior to operation of the cutting tool. Thereafter, the pump operates a downhole motor to rotate the cutting tool while the cutters are actuated.

In another aspect of the invention, the cutting tool is run into the wellbore on a run-in string of tubular. Fluid power to the cutter is provided from the surface of the well and rotation of the tool is also provided from the surface through the tubular string. In another aspect, the cutting tool is run into the wellbore on pressurizable coiled tubing to provide the forces necessary to actuate the cutting members and a downhole motor providing rotation to the cutting tool.

In another aspect of the invention, the apparatus includes a cutting tool having hydraulically actuated cutting members, a fluid filled pressure compensating housing, a torque anchor section with hydraulically deployed slips, a brushless dc motor with a source of electrical power from the surface, and a reduction gear box to step down the motor speed and increase the torque to the cutting tool, as well as one or more hydraulic pumps to provide activation pressure for the slips and the cutting tool. In operation, the anchor activates before the rolling element cutters thereby allowing the tool to anchor itself against the interior of the tubular to be cut prior to rotation of the cutting tool. Hydraulic fluid to power the apparatus is provided from a pressure compensated reservoir. As oil is pumped into the actuated portions of the apparatus, the compensation piston moves downward to take up space of used oil.

In yet another aspect of the invention, an expansion tool and a cutting tool are both used to affix a tubular string in a wellbore. In this embodiment, a liner is run into a wellbore and is supported by a bearing on a run-in string. Disposed on the run-in string, inside of an upper portion of the liner is a cutting tool and therebelow an expansion tool. As the apparatus reaches a predetermined location of the wellbore, the expander is actuated hydraulically and the liner portion therearound is expanded into contact with the casing therearound. Thereafter, with the weight of the liner transferred from the run-in string to the newly formed joint between the liner and the casing, the expander is de-actuated and the cutter disposed thereabove on the run-in string is actuated. The cutter, through axial and rotational forces, separates the liner into an upper and lower portion. Thereafter, the cutter is de-actuated and the expander therebelow is re-actuated. The expansion tool expands that portion of the liner remaining thereabove and is then de-actuated. After the separation and expanding operations are complete, the run-in string, including the cutter and expander are removed from the wellbore, leaving the liner in the wellbore with a joint between the liner and the casing therearound sufficient to fix the liner in the wellbore.

In yet another aspect, the invention provides apparatus and methods to join tubulars in a wellbore providing a connection therebetween with increased strength that facilitates the expansion of one tubular into another.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
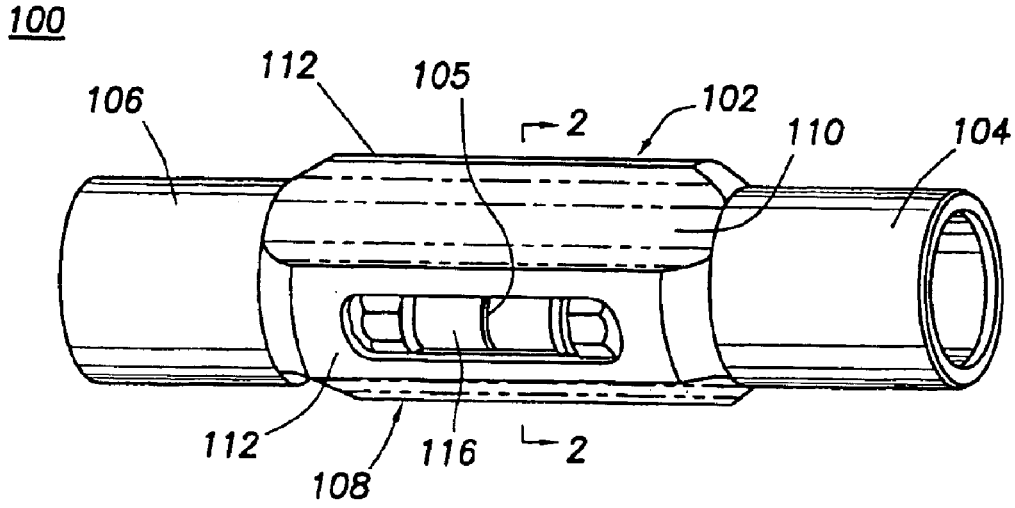
FIG. 1 is a perspective view of the cutting tool of the present invention.
Figure 2:
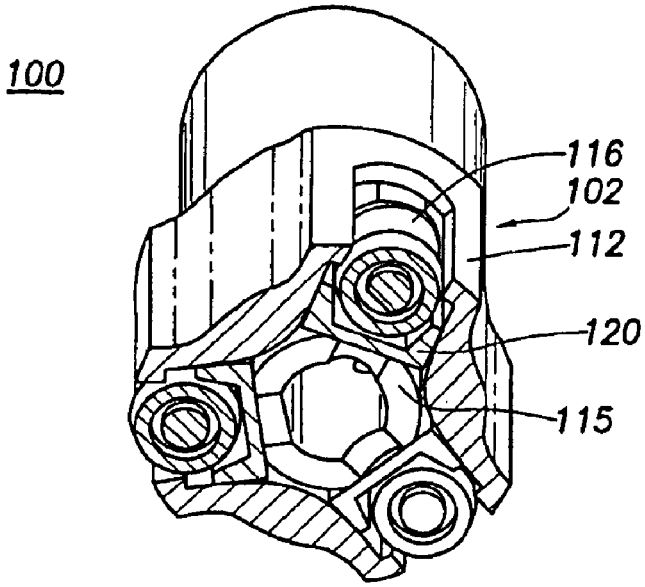
FIG. 2 is a perspective end view in section, thereof.
Figure 3:
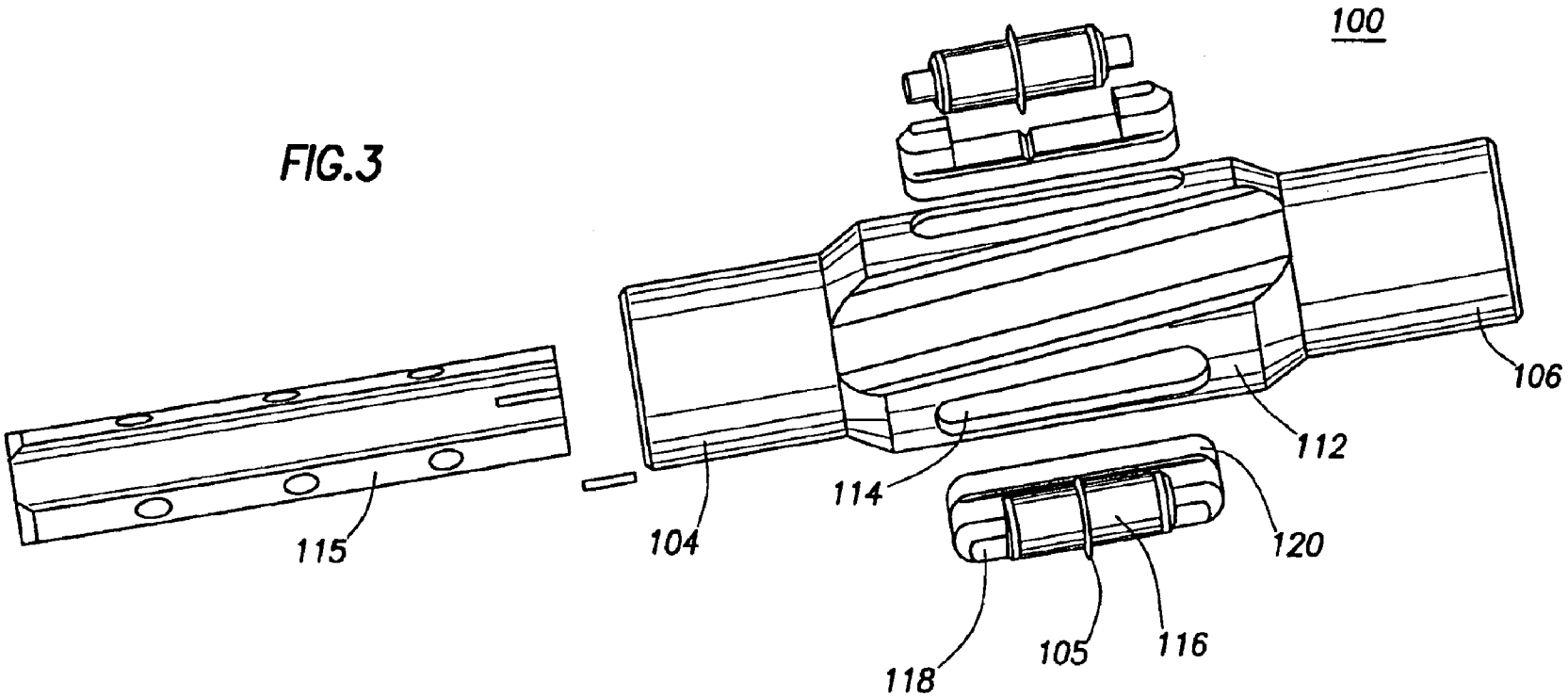
FIG. 3 is an exploded view of the cutting tool.

FIGS. 1 and 2 are perspective views of the cutting tool 100 of the present invention. FIG. 3 is an exploded view thereof. The tool 100 has a body 102 which is hollow and generally tubular with conventional screw-threaded end connectors 104 and 106 for connection to other components (not shown) of a downhole assembly. The end connectors 104 and 106 are of a reduced diameter (compared to the outside diameter of the longitudinally central body part 108 of the tool 100), and together with three longitudinal flutes 110 on the central body part 108, allow the passage of fluids between the outside of the tool 100 and the interior of a tubular therearound (not shown). The central body part 108 has three lands 112 defined between the three flutes 110, each land 112 being formed with a respective recess 114 to hold a respective roller 116. Each of the recesses 114 has parallel sides and extends radially from the radially perforated tubular core 115 of the tool 100 to the exterior of the respective land 112. Each of the mutually identical rollers 116 is near-cylindrical and slightly barreled with a single cutter 105 formed thereon. Each of the rollers 116 is mounted by means of a bearing 118 (FIG. 3) at each end of the respective roller for rotation about a respective rotation axis which is parallel to the longitudinal axis of the tool 100 and radially offset therefrom at 120-degree mutual circumferential separations around the central body 108. The bearings 118 are formed as integral end members of radially slidable pistons 120, one piston 120 being slidably sealed within each radially extended recess 114. The inner end of each piston 120 (FIG. 2) is exposed to the pressure of fluid within the hollow core of the tool 100 by way of the radial perforations in the tubular core 115.

By suitably pressurizing the core 115 of the tool 100, the pistons 120 can be driven radially outwards with a controllable force which is proportional to the pressurization, and thereby the rollers 116 and cutters 105 can be forced against the inner wall of a tubular in a manner described below. Conversely, when the pressurization of the core 115 of the tool 100 is reduced to below whatever is the ambient pressure immediately outside the tool 100, the pistons 120 (together with the piston-mounted rollers 116) are allowed to retract radially back into their respective recesses 114.

Figure 4:
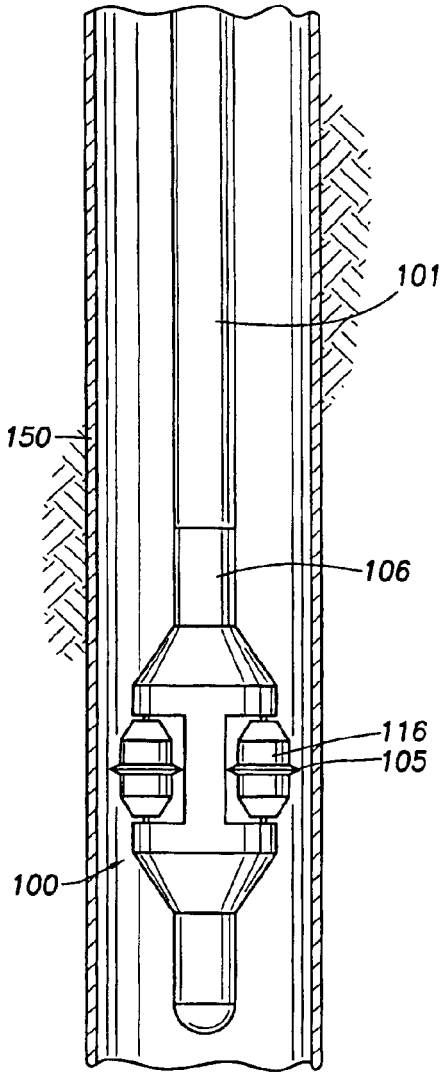
FIG. 4 is a section view of the cutting tool disposed in a wellbore at the end of a run-in string and having a tubular therearound.
Figure 5:
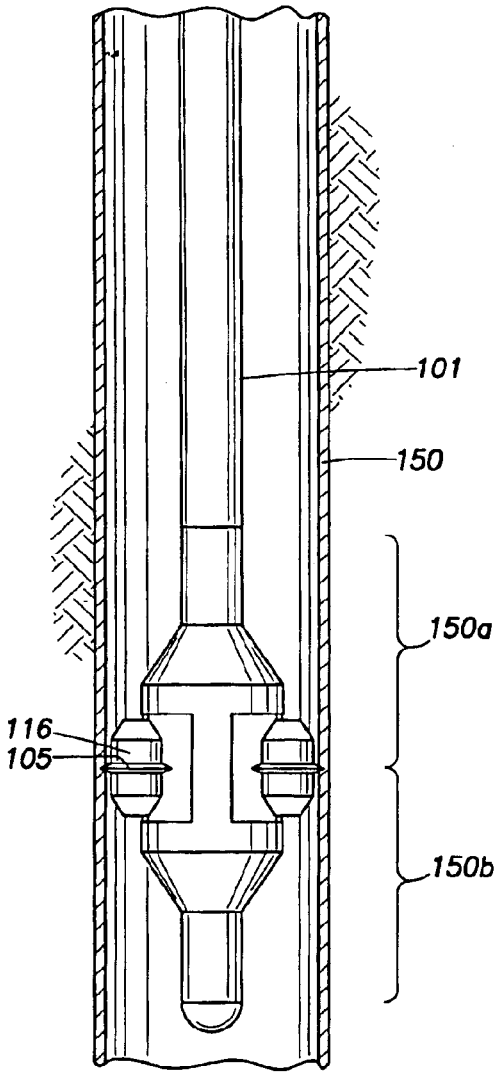
FIG. 5 is a section view of the apparatus of FIG. 4, wherein cutters are actuated against the inner wall of the tubular therearound.

FIG. 4 is a section view of the cutting tool 100 disposed at the end of a tubular run-in string 101 in the interior of a tubular 150. In the embodiment shown, the tubular 150 is a liner portion functioning to line a borehole. However, it will be understood that the cutting tool 100 could be used to sever any type of tubular in a wellbore and the invention is not limited to use with a tubular lining the borehole of a well. The run-in string 101 is attached to a first end connector 106 of the cutting tool 100 and the tool is located at a predetermined position within the tubular 150. With the cutting tool 100 positioned in the tubular 150, a predetermined amount of fluid pressure is supplied through the run-in string 101. The pressure is adequate to force the pistons 120 and the rollers 116 with their cutters 105 against the interior of the tubular. With adequate force applied, the run-in string 101 and cutting tool 100 are rotated in the tubular, thereby causing a groove of ever increasing depth to be formed around the inside of the tubular 150. FIG. 5 is a section view of the apparatus of FIG. 4 wherein the rollers 116 with their respective cutters 105 are actuated against the inner surface of the tubular 150. With adequate pressure and rotation, the tubular is separated into an upper 150*a* and lower 150*b* portions. Thereafter, with a decrease in fluid pressure, the rollers 116 are retracted and the run-in string 101 and cutting tool 100 can be removed form the wellbore.

Figure 6:
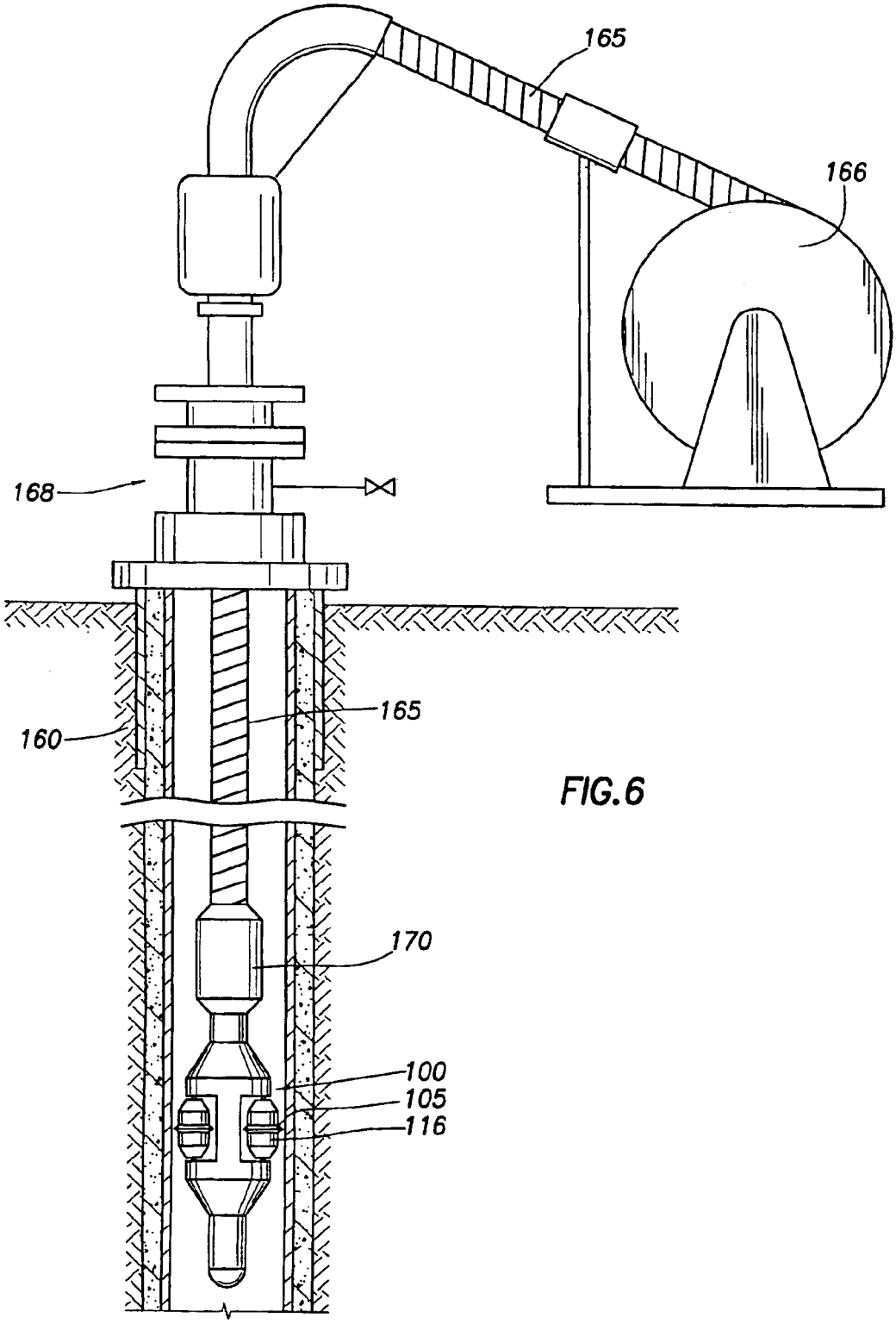
FIG. 6 is a view of a well, partially in section, illustrating a cutting tool and a mud motor disposed on coil tubing.

FIG. 6 illustrates an alternative embodiment of the invention including a cutting tool 100 disposed in a wellbore 160 on a run-in string 165 of coil tubing. A mud motor 170 is disposed between the lower end of the coil tubing string 165 and the cutting tool 100 and provides rotational force to the tool 100. In this embodiment, pressurized fluid adequate to actuate the rollers 116 with their cutters 105 is provided in the coil tubing string 165 The mud 170 motor is also operated by fluid in the coil tubing string 165 and an output shaft of the mud motor is coupled to an input shaft of the cutting tool 100 to provide rotation to the cutting tool 100. Also illustrated in FIG. 6 is a coil tubing reel 166 supplying tubing which is run into the wellbore 160 through a conventional wellhead assembly 168. With the use of appropriate known pressure containing devices, the cutting tool 100 can be used in a live well.

Figure 7:
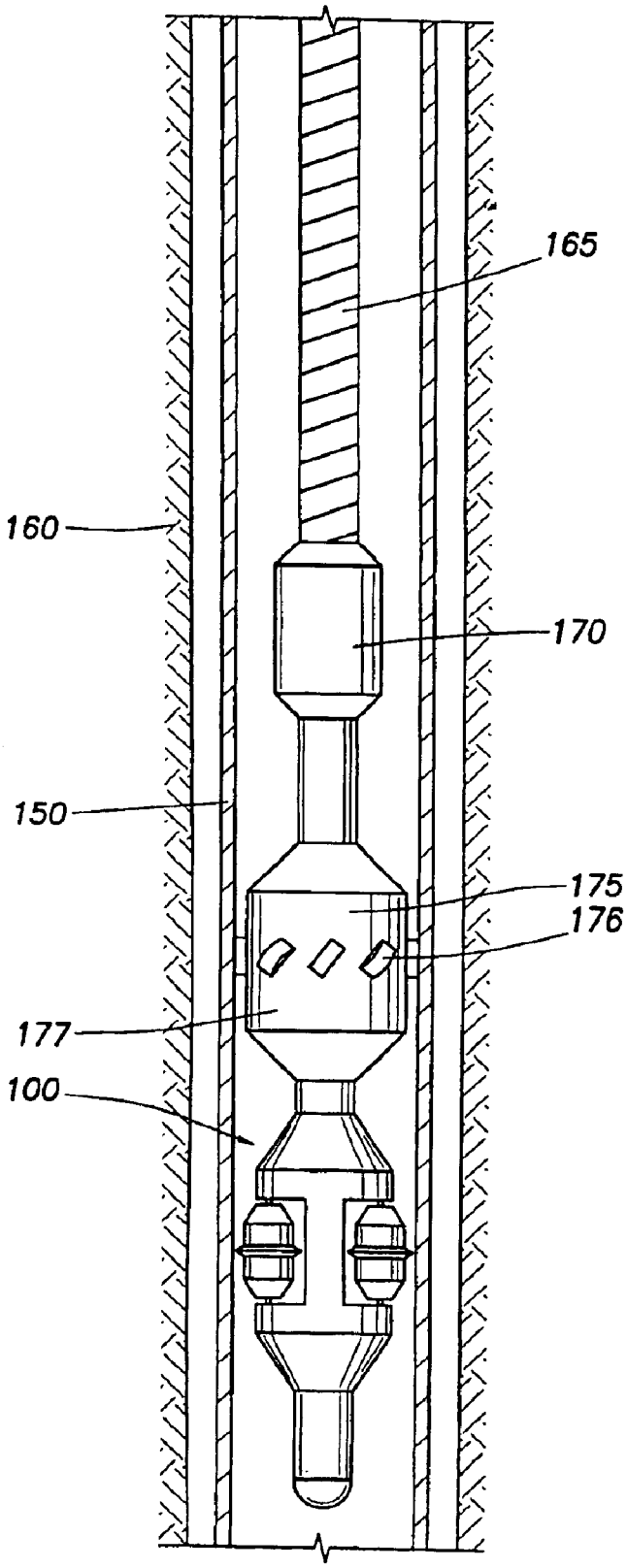
FIG. 7 is a section view of a wellbore illustrating a cutting tool, mud motor and tractor disposed on coil tubing.

FIG. 7 is a section view illustrating a cutting tool 100 disposed on coil tubing 165 in a wellbore 160 with a mud motor 170 and a tractor 175 disposed thereabove. As in the embodiment of FIG. 6, the cutting tool 100 receives a source of pressurized fluid for actuation from the coil tubing string 165 thereabove. The mud motor 170 provides rotational force to the cutter. Additionally, the tractor 175 provides axial movement necessary to move the cutting tool assembly in the wellbore. The tractor is especially useful when gravity alone would not cause the necessary movement of the cutting tool 100 in the wellbore 160. Axial movement can be necessary in order to properly position the cutting tool 100 in a non-vertical wellbore, like a horizontal wellbore. Tractor 175, like the cutting tool includes a number of radially actuable rollers 176 that extend outward to contact the inner wall of a tubular 150 therearound. The spiral arrangement of the rollers 176 on the body 177 of the tractor 175 urge the tractor axially when rotational force is applied to the tractor body 177.

Figure 8:
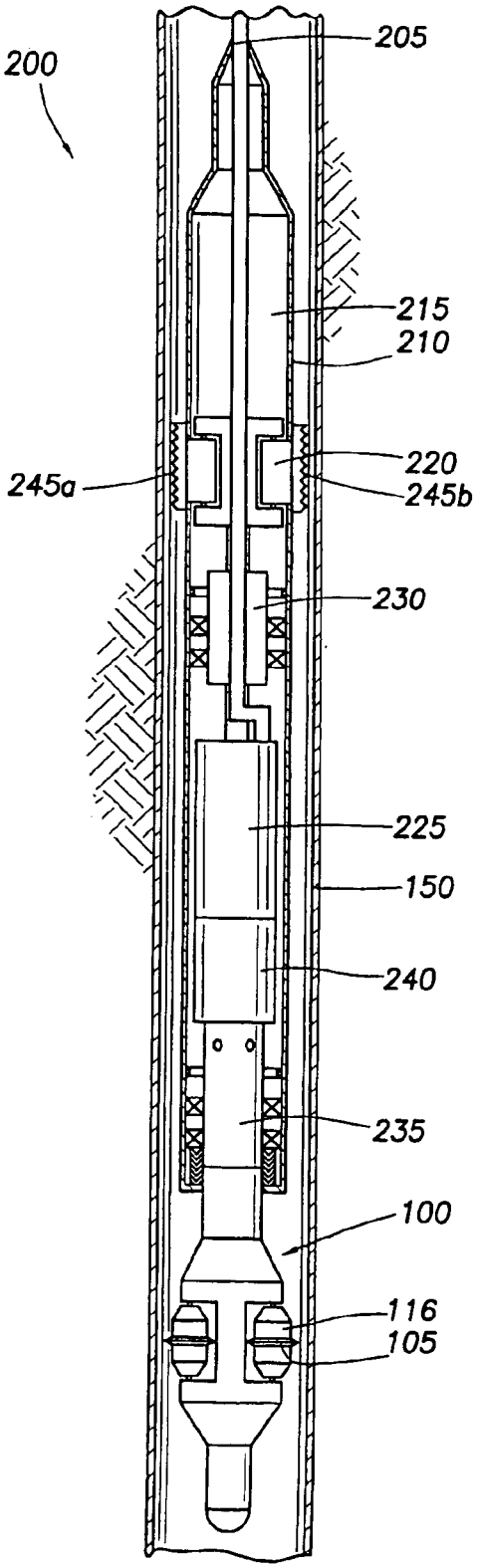
FIG. 8 is a section view of an apparatus including a cutting tool, motor/pump and slip assembly disposed on a wireline.

FIG. 8 is a section view of an apparatus 200 including the cutting tool 100 disposed in a tubular 150 on wireline 205. In use, the apparatus 200 is run into a wellbore on wireline extending from the surface of the well (not shown). The wireline 205 serves to retain the weight of the apparatus 200 and also provide a source of power electrical to components of the apparatus. The apparatus 200 is designed to be lowered to a predetermined depth in a wellbore where a tubular 150 therearound is to be separated. Included in the apparatus 200 is a housing 210 having a fluid reservoir 215 with a pressure compensating piston (not shown), a hydraulically actuated slip assembly 220 and a cutting tool 100 disposed below the housing 210. The pressure compensating piston 215 allows fluid in the reservoir 215 to expand and contract with changes in pressure and isolates the fluid in the reservoir fluid from wellbore fluid therearound. Disposed between the slip assembly 220 and the cutting tool 100 is a brushless dc motor 225 powering two reciprocating hydraulic pumps 230, 235 and providing rotational movement to the cutter tool 100. Each pump is in fluid communication with reservoir 215. The upper pump 230 is constructed and arranged to provide pressurized fluid to the slip assembly 220 in order to cause slips to extend outwardly and contact the tubular 150 therearound. The lower pump 235 is constructed and arranged to provide pressurized fluid to the cutting tool 100 in order to actuate rollers 116 and cutters 105 and force them into contact with the tubular 150 therearound. A gearbox 240 is preferably disposed between the output shaft of the motor and the rotational shaft of the cutting tool. The gearbox 240 functions to provide increased torque to the cutting tool 100. The pumps 230, 235 are preferably axial piston, swash plate-type pumps having axially mounted pistons disposed alongside the swash plate. The pumps are designed to alternatively actuate the pistons with the rotating swash plate, thereby providing fluid pressure to the components. However, either pump 230, 235 could also be a plain reciprocating, gear rotor or spur gear-type pump. The upper pump, disposed above the motor 225, preferably runs at a higher speed than the lower pump ensuring that the slip assembly 220 will be actuated and will hold the apparatus 200 in a fixed position relative to the tubular 150 before the cutters 105 contact the inside wall of the tubular. The apparatus 200 will thereby anchor itself against the inside of the tubular 150 to permit rotational movement of the cutting tool 100 therebelow.

Hydraulic fluid to power the both the upper 230 and lower 235 pumps is provided from the pressure compensated reservoir 215. As fluid is pumped behind a pair of slip members 245*a*, 245*b* located on the slip assembly 220, the compensation piston will move in order to take up space of the fluid as it is utilized. Likewise, the rollers 116 of the cutting tool 100 operate on pressurized fluid from the reservoir 215.

The slip members 245*a*, 245*b* and the radially slidable pistons 210 housing the rollers 116 and cutters 105 preferably have return springs installed therebehind which will urge the pistons 245*a*, 245*b*, 210 to a return or a closed position when the power is removed and the pumps 230, 235 have stopped operating. Residual pressure within the system is relieved by means of a control orifice or valves in the supply line (not shown) to the pistons 245*a*, 245*b*, 120 of the slip assembly and the cutting tool 100. The valves or controlled orifices are preferably set to dump oil at a much lower rate than the pump output. In this manner, the apparatus of the present invention can be run into a wellbore to a predetermined position and then operated by simply supplying power from the surface via the wireline 205 in order to fix the apparatus 200 in the wellbore and cut the tubular. Finally, after the tubular 150 has been severed and power to the motor 225 has been removed, the slips 245*a*, 245*b* and cutters 105 will de-actuate with the slips 245*a*, 245*b* and the cutters 105 returning to their respective housings, allowing the apparatus 200 to be removed from the wellbore.

Figure 9:
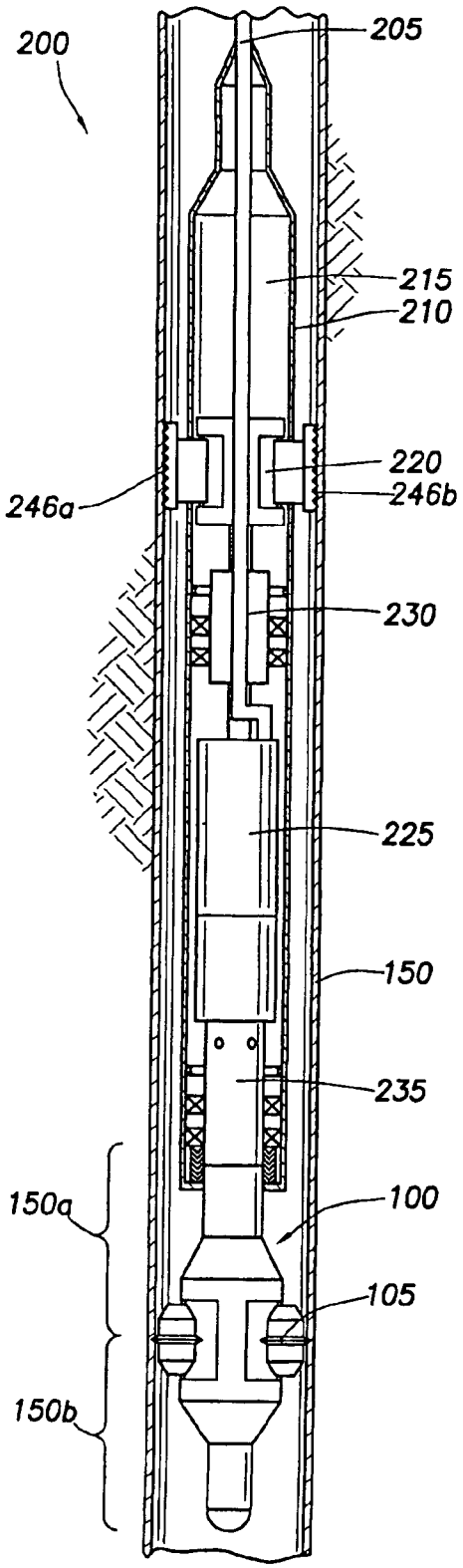
FIG. 9 is a section view of the apparatus of FIG. 6, with the cutting tool and a slip assembly actuated against the inner wall of a tubular therearound.

FIG. 9 is a section view of the apparatus 200 of FIG. 9 with the slip assembly 220 actuated and the cutting tool 100 having its cutting surfaces 105 in contact with the inside wall of the tubular 150. In operation, the apparatus 200 is run into the wellbore on a wireline 205. When the apparatus reaches a predetermined location in the wellbore or within some tubular therein to be severed, power is supplied to the brushless dc motor 225 through the wireline 205. The upper pump 230, running at a higher speed than the lower pump 235, operates the slip assembly 220 causing the slips 246*a*, 246*b* to actuate and grip the inside surface of the tubular 150. Thereafter, the lower hydraulic pump 235 causes the cutters 105 to be urged against the tubing 150 at that point where the tubing is to be severed and the cutting tool 100 begins to rotate. Through rotation of the cutting tool 100 and radial pressure of the cutters 105 against the inside wall of the tubular 150, the tubular can be partially or completely severed and an upper portion 150*a* of the tubing separated from a lower portion 150*b* thereof. At the completion of the operation, power is shut off to the apparatus 200 and through a spring biasing means, the cutters 105 are retracted into the body of the cutting tool 100 and the slips 246*a*, 246*b* retract into the housing of the slip assembly 220. The apparatus 200 may then be removed from the wellbore. In an alternative embodiment, the slip assembly 220 can be caused to stay actuated whereby the upper portion 150*a* of the severed tubular 150 is carried out of the well with the apparatus 200.

Figure 10:
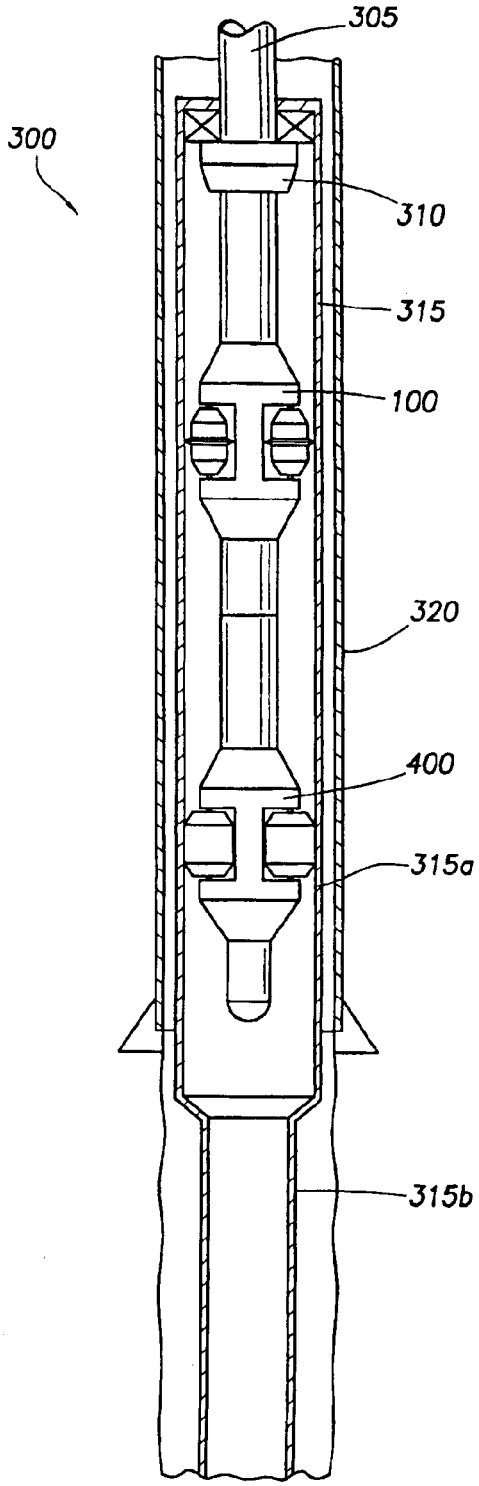
FIG. 10 is a section view of a liner hanger apparatus including a liner portion, and run-in string with a cutting tool and an expansion tool disposed thereon.

FIG. 10 is a section view showing another embodiment of the invention. In this embodiment, an apparatus 300 for joining downhole tubulars and then severing a tubular above the joint is provided. The apparatus 300 is especially useful in fixing or hanging a tubular in a wellbore and utilizes a smaller annular area than is typically needed for this type operation. The apparatus 300 includes a run-in tubular 305 having a cutting tool 100 and an expansion tool 400 disposed thereon.

Figure 11:
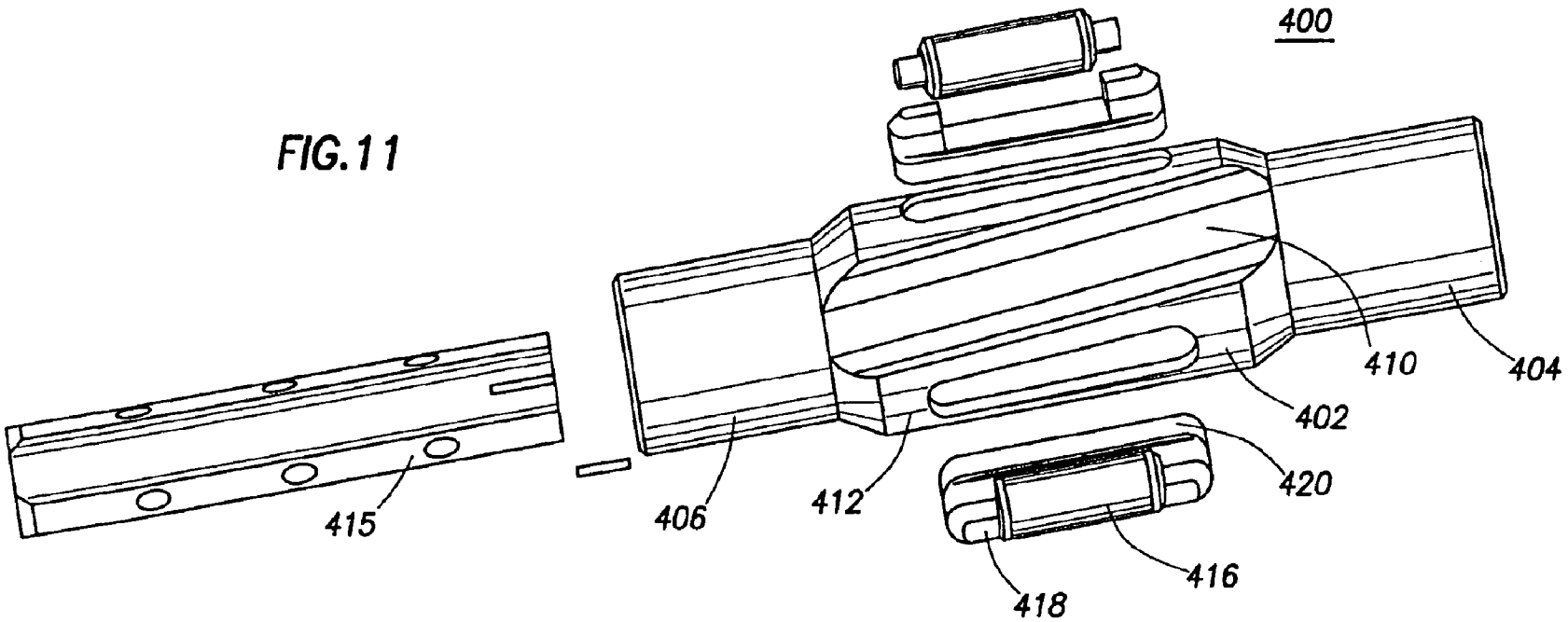
FIG. 11 is an exploded view of the expansion tool.

FIG. 11 is an exploded view of the expansion tool. The expansion tool 400, like the cutting tool 100 has a body 402 which is hollow and generally tubular with connectors 404 and 406 for connection to other components (not shown) of a downhole assembly. The end connectors 404 and 406 are of a reduced diameter (compared to the outside diameter of the longitudinally central body 402 of the tool 400), and together with three longitudinal flutes 410 on the body 402, allow the passage of fluids between the outside of the tool 400 and the interior of a tubular therearound (not shown). The body 402 has three lands 412 defined between the three flutes 410, each land 412 being formed with a respective recess 414 to hold a respective roller 416. Each of the recesses 414 has parallel sides and extends radially from the radially perforated tubular core 415 of the tool 400 to the exterior of the respective land 412. Each of the mutually identical rollers 416 is near-cylindrical and slightly barreled. Each of the rollers 416 is mounted by means of a bearing 418 at each end of the respective roller for rotation about a respective rotation axis which is parallel to the longitudinal axis of the tool 400 and radially offset therefrom at 120-degree mutual circumferential separations around the central body 408. The bearings 418 are formed as integral end members of radially slidable pistons 420, one piston 420 being slidably sealed within each radially extended recess 414. The inner end of each piston 420 is exposed to the pressure of fluid within the hollow core of the tool 400 by way of the radial perforations in the tubular core 415 (FIG. 10).

Referring again to FIG. 10, also disposed upon the run-in string and supported thereon by a bearing member 310 is a liner portion 315 which is lowered into a wellbore along with the apparatus 300 for installation therein. In the embodiment shown in FIG. 10, the bearing member 310 supports the weight of the liner portion 315 and permits rotation of the run-in string independent of the liner portion 315. The liner 315 consists of tubular having a first, larger diameter portion 315*a* which houses the cutting tool 100 and expansion tool 400 and a tubular of a second, small diameter 315*b* therebelow. One use of the apparatus 300 is to fix the liner 315 in existing casing 320 by expanding the liner into contact with the casing and thereafter, severing the liner at a location above the newly formed connection between the liner 315 and the casing 320.

Figure 12:
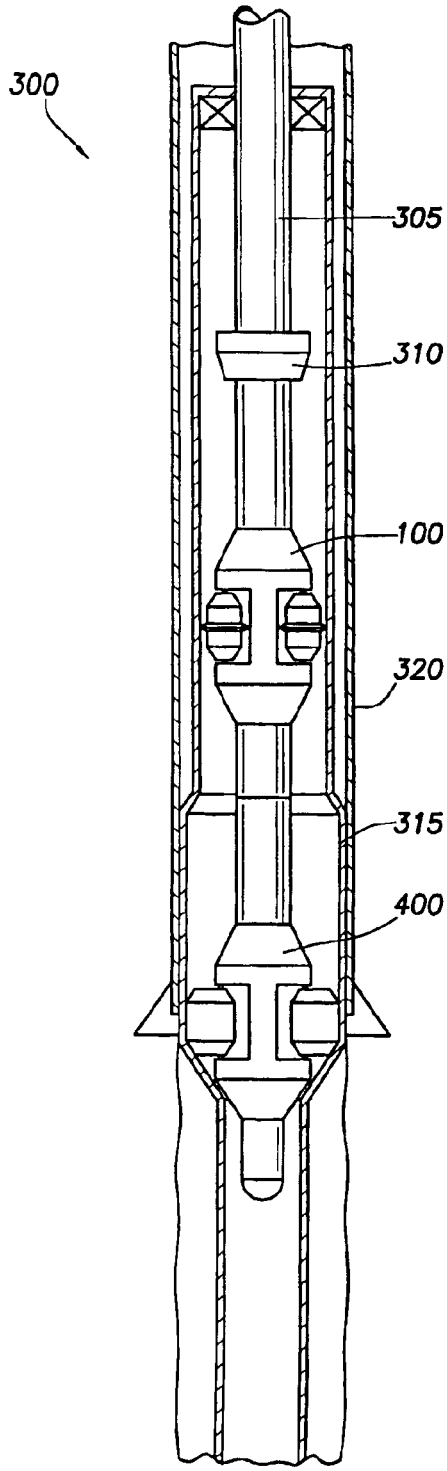
FIG. 12 is a section view of the liner hanger apparatus of FIG. 8 illustrating a section of the liner having been expanded into the casing therearound by the expansion tool.

FIG. 12 is a section view of the apparatus 300 illustrating a portion of the larger diameter tubular 315*a* having been expanded into casing 320 by the expanding tool 400. As is visible in the Figure, the expanding tool 400 is actuated and through radial force and axial movement, has enlarged a given section of the tubular 315*a* therearound. Once the tubular 315 is expanded into the casing 320, the weight of the liner 315 is borne by the casing 320 therearound, and the run-in string 305 with the expanding 400 and cutting 105 tools can independently move axially within the wellbore. Preferably, the tubular 315 and casing 325 are initially joined only in certain locations and not circumferentially. Consequently, there remains a fluid path between the liner and casing and any cement to be circulated in the annular area between the casing 325 and the outside diameter of the liner 315 can be introduced into the wellbore 330.

Figure 13:
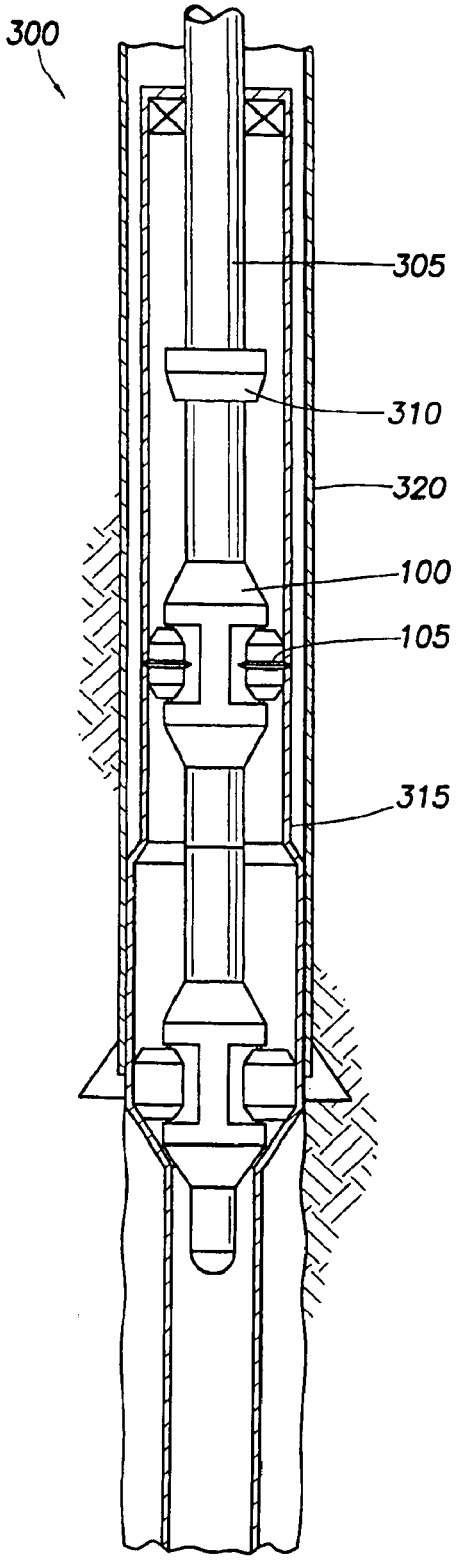
FIG. 13 is a section view of the liner hanger apparatus with the cutting tool actuated in order to separate the liner therearound into an upper and lower portion.
Figure 14:
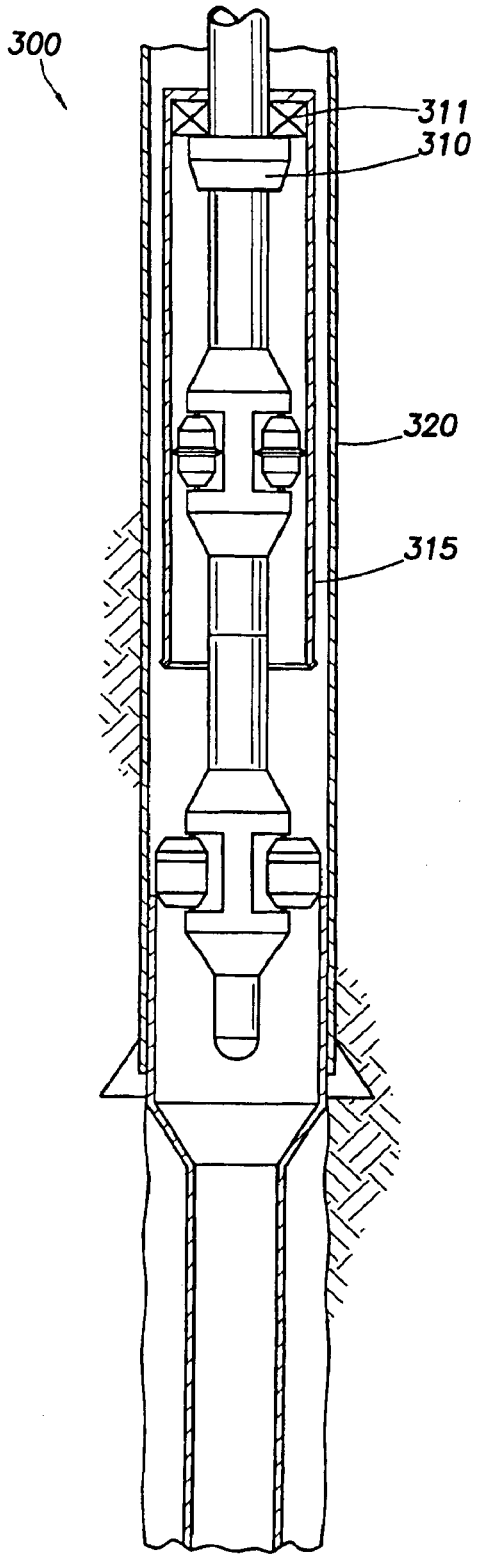
FIG. 14 is a section view of the liner hanger apparatus with an additional portion of the liner expanded by the expansion tool.

FIG. 13 is a section view of the apparatus 300 whereby the cutting tool 100 located on the run-in string 305 above the expansion tool 400 and above that portion of the liner which has been expanded, is actuated and the cutters 105, through rotational and radial force, separate the liner into an upper and lower portion. This step is typically performed before any circulated cement has cured in the annular area between the liner 315 and casing 320. Finally, FIG. 14 depicts the apparatus 300 of the present invention in the wellbore after the liner 315 has been partially expanded, severed and separated into an upper and lower portion and the upper portion of the expanded liner 315 has been "rolled out" to give the new liner and the connection between the liner and the casing a uniform quality. At the end of this step, the cutter 100 and expander 400 are de-actuated and the piston surfaces thereon are retracted into the respective bodies. The run-in string is then raised to place the bearing 310 in contact with shoulder member at the top of the liner 315. The apparatus 300 can then be removed from the wellbore along with the run-in string 305, leaving the liner installed in the wellbore casing.

As the foregoing demonstrates, the present invention provides an easy efficient way to separate tubulars in a wellbore without the use of a rigid run-in string. Alternatively, the invention provides a trip saving method of setting a string of tubulars in a wellbore. Also provided is a space saving means of setting a liner in a wellbore by expanding a first section of tubular into a larger section of tubular therearound.

As illustrated by the foregoing, it is possible to form a mechanical connection between two tubulars by expanding the smaller tubular into the inner surface of the larger tubular and relying upon friction therebetween to affix the tubulars together. In this manner, a smaller string of tubulars can be hung from a larger string of tubulars in a wellbore. In some instances, it is necessary that the smaller diameter tubular have a relatively thick wall thickness in the area of the connection in order to provide additional strength for the connection as needed to support the weight of a string of tubulars therebelow that may be over 1,000 ft. in length. In these instances, expansion of the tubular can be frustrated by the excessive thickness of the tubular wall. For instance, tests have shown that as the thickness of a tubular wall increases, the outer surface of the tubular can assume a tensile stress as the interior surface of the wall is placed under a compressive radial force necessary for expansion. When using the expansion tool of the present invention to place an outwardly directed radial force on the inner wall of a relating thick tubular, the expansion tool, with its actuated rollers, places the inner surface of the tubular in compression. While the inside surface of the wall is in compression, the compressive force in the wall will approach a value of zero and subsequently take on a tensile stress at the outside surface of the wall. Because of the tensile stress, the radial forces applied to the inner surface of the tubular may be inadequate to efficiently expand the outer wall past its elastic limits.

Figure 15:
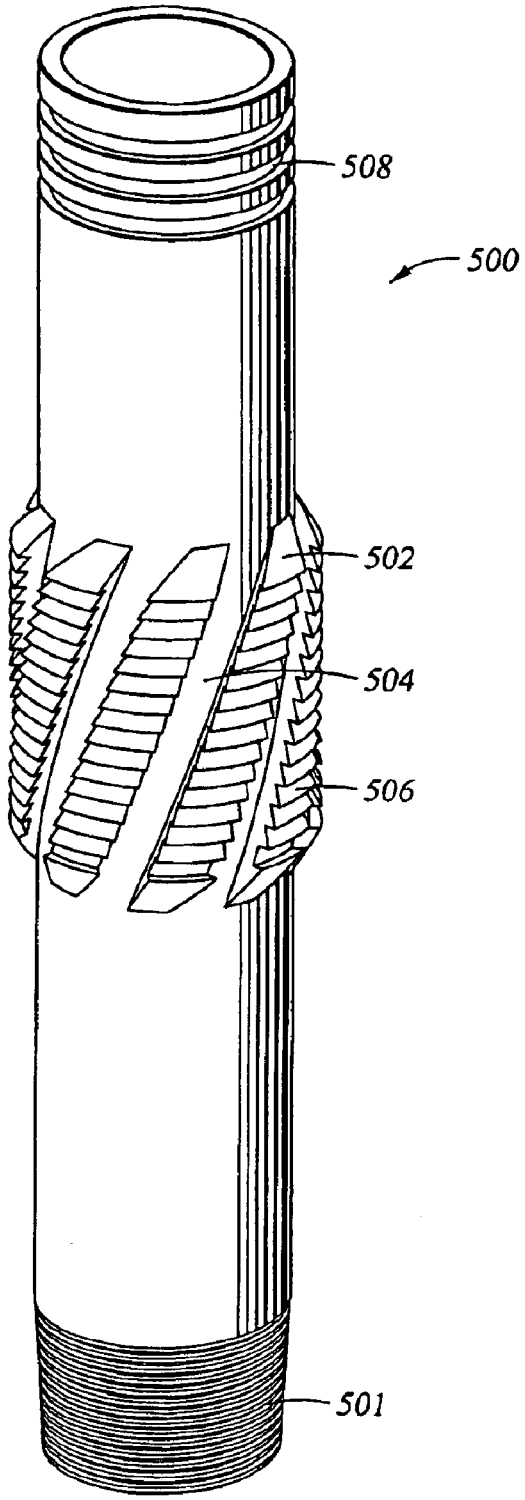
FIG. 15 is a perspective view of a tubular for expansion into and connection to another tubular.

In order to facilitate the expansion of tubulars, especially those requiring a relatively thick wall in the area to be expanded, formations are created on the outer surface of the tubular as shown in FIG. 15. FIG. 15 is a perspective view of a tubular 500 equipped with threads at a first end to permit installation on an upper end of a tubular string (not shown). The tubular includes substantially longitudinal formations 502 formed on an outer surface thereof. The formations 502 have the effect of increasing the wall thickness of the tubular 500 in the area of the tubular to be expanded into contact with an outer tubular. This selective increase in wall thickness reduces the tensile forces developed on the outer surface of the tubular wall and permits the smaller diameter tubular to be more easily expanded into the larger diameter tubular. In the example shown in FIG. 15, the formations 502 and grooves 504 formed on the outer surface of the tubular 500 therebetween are not completely longitudinal but are spiraled in their placement along the tubular wall. The spiral shape of the grooves and formations facilitate the flow of fluids, like cement and also facilitate the expansion of the tubular wall as it is acted upon by an expansion tool. Additionally, formed on the outer surface of formations 502 are slip teeth 506 which are specifically designed to contact the inner surface of a tubular therearound, increasing frictional resistance to downward axial movement. In this manner, the tubular can be expanded in the area of the formations 502 and the formations, with their teeth 506 will act as slips to prevent axial downward movement of the tubing string prior to cementing of the tubular string in the wellbore. Formed on the outer surface of the tubular 500 above the formations 502 are three circumferential grooves 508 which are used with seal rings (not shown) to seal the connection created between the expanded inner tubular 500 and an outer tubular.

Figure 16:
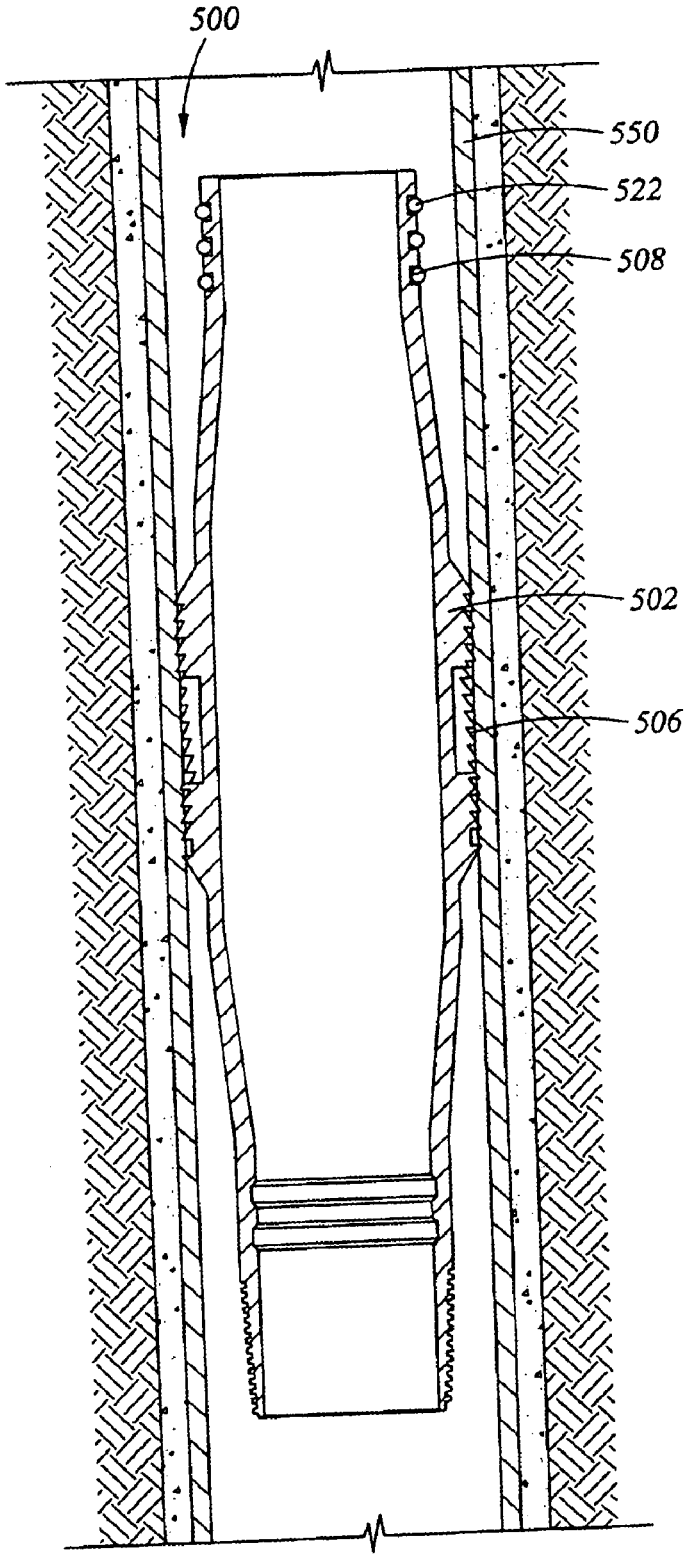
FIG. 16 is the tubular of FIG. 15 partially expanded into contact with an outer tubular.

FIG. 16 is a section view of the tubular 500 with that portion including the formations 502 expanded into contact with a larger diameter tubular 550 therearound. As illustrated in FIG. 16, that portion of the tubular including the formations has been expanded outwards through use of an expansion tool (not shown) to place the teeth 506 formed on the formations 502 into frictional contact with the larger tubular 550 therearound. Specifically, an expansion tool operated by a source of pressurized fluid has been inserted into the tubular 500 and through selective operation, expanded a portion of tubular 500. The spiral shape of the formations 502 has resulted in a smoother expanded surface of the inner tubular as the rollers of the expansion tool have moved across the inside of the tubular at an angle causing the rollers to intersect the angle of the formations opposite the inside wall of the tubular 500. In the condition illustrated in FIG. 16, the weight of the smaller diameter tubular 500 (and any tubular string attached thereto) is borne by the larger diameter tubular 550. However, the grooves 504 defined between the formations 502 permit fluid, like cement to circulate through the expanded area between the tubulars 500, 550.

Figure 17:
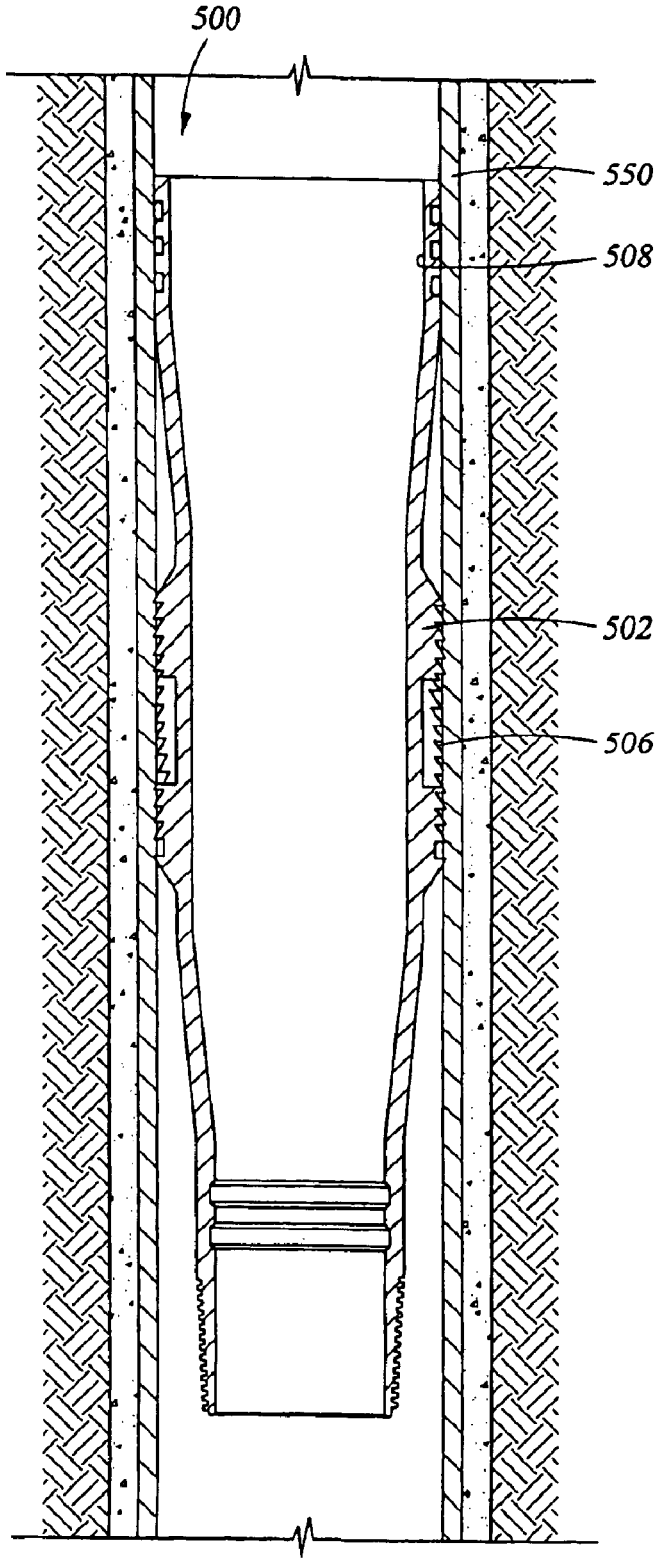
FIG. 17 is the tubular of FIG. 16 fully expanded into the outer tubular with a seal therebetween.

FIG. 17 is a section view of the tubular 500 of FIG. 16 wherein the upper portion of the tubular 500 has also been expanded into the inner surface of the larger diameter tubular 550 to effect a seal therebetween. As illustrated, the smaller tubular is now mechanically and sealingly attached to the outer tubular through expansion of the formations 502 and the upper portion of the smaller tubular 550 with its circumferential grooves 508. Visible in FIG. 16, the grooves 508 include rings 522 made of some elastomeric material that serves to seal the annular area between the tubulars 500, 550 when expanded into contact with each other. Typically, this step is performed after cement has been circulated around the connection point but prior to the cement having cured.

In use, the connection would be created as follows: A tubular string 500 with the features illustrated in FIG. 15 is lowered into a wellbore to a position whereby the formations 502 are adjacent the inner portion of an outer tubular 550 where a physical connection between the tubulars is to be made. Thereafter, using an expansion tool of the type disclosed herein, that portion of the tubular bearing the formations is expanded outwardly into the outer tubular 550 whereby the formations 502 and any teeth formed thereupon are placed in frictional contact with the tubular 550 therearound. Thereafter, with the smaller diameter tubular fixed in place with respect to the larger diameter outer tubular 550, any fluids, including cement are circulated through an annular area created between the tubulars 500, 550 or tubular 500 and a borehole therearound. The grooves 504 defined between the formations 502 of the tubular 500 permit fluid to pass therethrough even after the formations have been urged into contact with the outer tubular 550 through expansion. After any cement has been circulated through the connection, and prior to any cement curing, the connection between the inner and outer tubulars can be sealed. Using the expansion tool described herein, that portion of the tubular having the circumferential grooves 508 therearound with rings 522 of elastomeric material therein is expanded into contact with the outer tubular 550. A redundant sealing means over the three grooves 508 is thereby provided.

Figure 18:
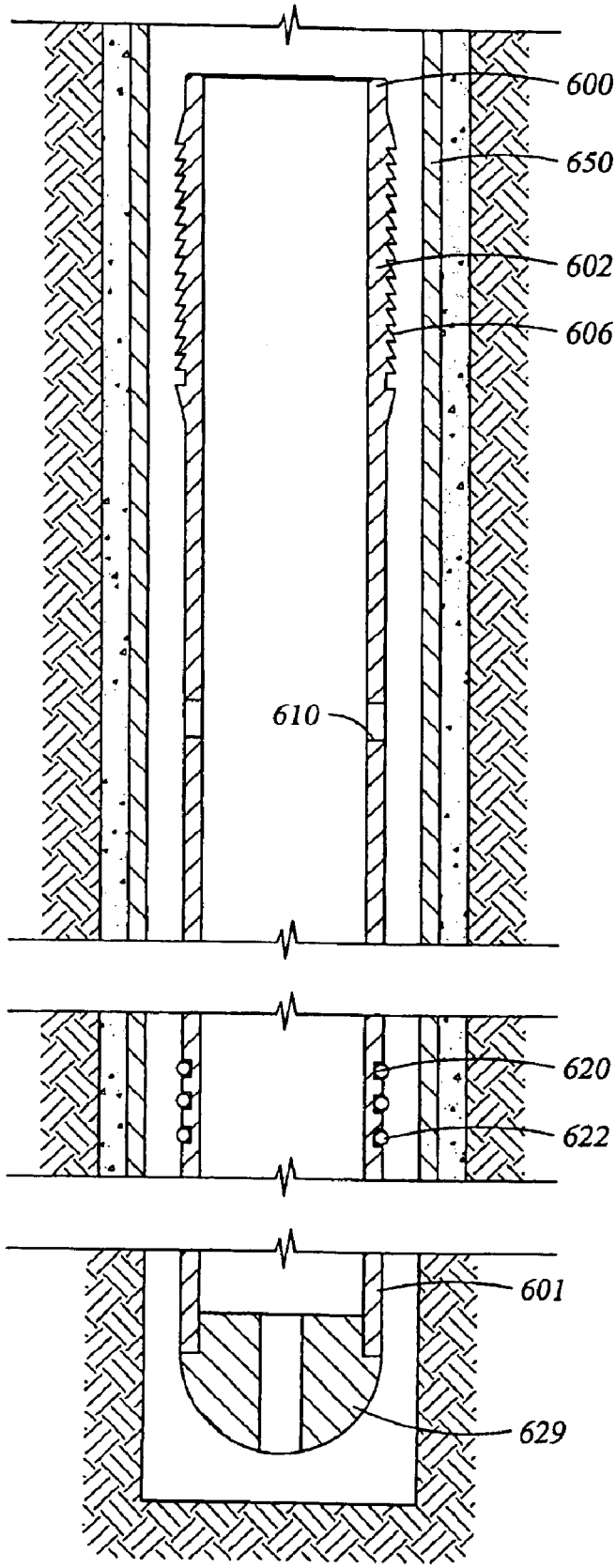
FIG. 18 is an alternative embodiment of a tubular for expansion into and in connection to another tubular.

In another aspect, the invention provides a method and apparatus for expanding a first tubular into a second and thereafter, circulating fluid between the tubulars through a fluid path independent of the expanded area of the smaller tubular. FIG. 18 is a section view of a first, smaller diameter tubular 600 coaxially disposed in an outer, larger diameter tubular 650. As illustrated, the upper portion of the smaller diameter tubular includes a circumferential area 602 having teeth 606 formed on an outer surface thereof which facilitate the use of the circumferential area 602 as a hanger portion to fixedly attach the smaller diameter tubular 600 within the larger diameter tubular 650. In the illustration shown, the geometry of the teeth 606 formed on the outer surface of formations 602 increase the frictional resistance of a connection between the tubulars 600, 650 to a downward force. Below the circumferential area 602 are two apertures 610 formed in a wall of the smaller diameter tubular 600. The purpose of apertures 610 is to permit fluid to pass from the outside of the smaller diameter tubular 600 to the inside thereof as will be explained herein. Below the apertures 610 are three circumferential grooves 620 formed in the wall of the smaller diameter tubular 600. These grooves 620 aid in forming a fluid tight seal between the smaller diameter and larger diameter tubulars 600, 650. The grooves 620 would typically house rings 622 of elastomeric material to facilitate a sealing relationship with a surface therearound. Alternatively, the rings could be any malleable material to effect a seal. Also illustrated in FIG. 18 is a cone portion 629 installed at the lower end of a tubular string 601 extending from the tubular 600. The cone portion 629 facilitates insertion of the tubular 601 into the wellbore.

Figure 19:
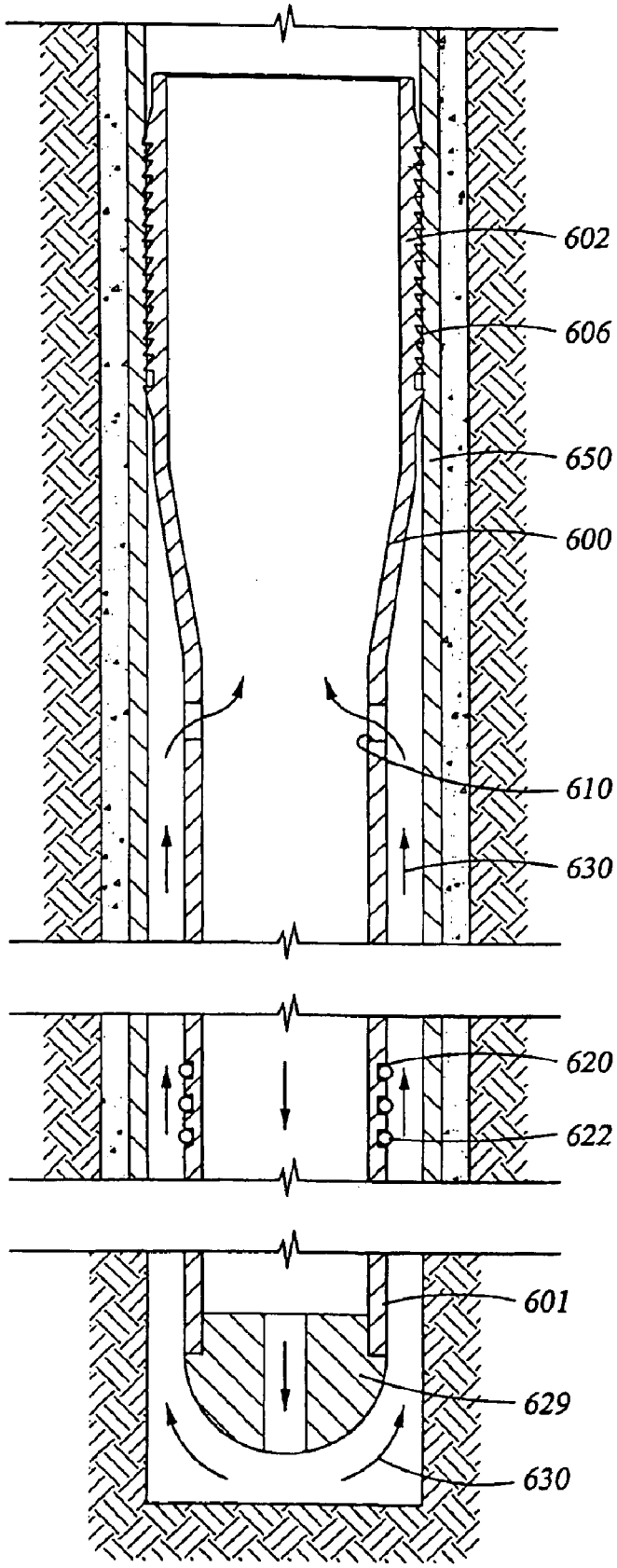
FIG. 19 is a section view of the tubular of FIG. 18 with a portion thereof expanded into a larger diameter tubular therearound and illustrating a fluid path of fluid through an annulus area.

FIG. 19 is a section view of the smaller 600 and larger 650 diameter tubulars of FIG. 18 after the smaller diameter tubular 600 has been expanded in the circumferential area 602. As illustrated in FIG. 19, area 602 with teeth 606 has been placed into frictional contact with the inner surface of the larger tubular 650. At this point, the smaller diameter tubular 600 and any string of tubular 601 attached therebelow is supported by the outer tubular 650. However, there remains a clear path for fluid to circulate in an annular area formed between the two tubulars as illustrated by arrows 630. The arrows 630 illustrate a fluid path from the bottom of the tubular string 601 upwards in an annulus formed between the two tubulars and through apertures 610 formed in smaller diameter tubular 600. In practice, cement would be delivered into the tubular 610 to some point below the apertures 610 via a conduit (not shown). A sealing mechanism around the conduit (not shown) would urge fluid returning though apertures 610 towards the upper portion of the wellbore.

Figure 20:
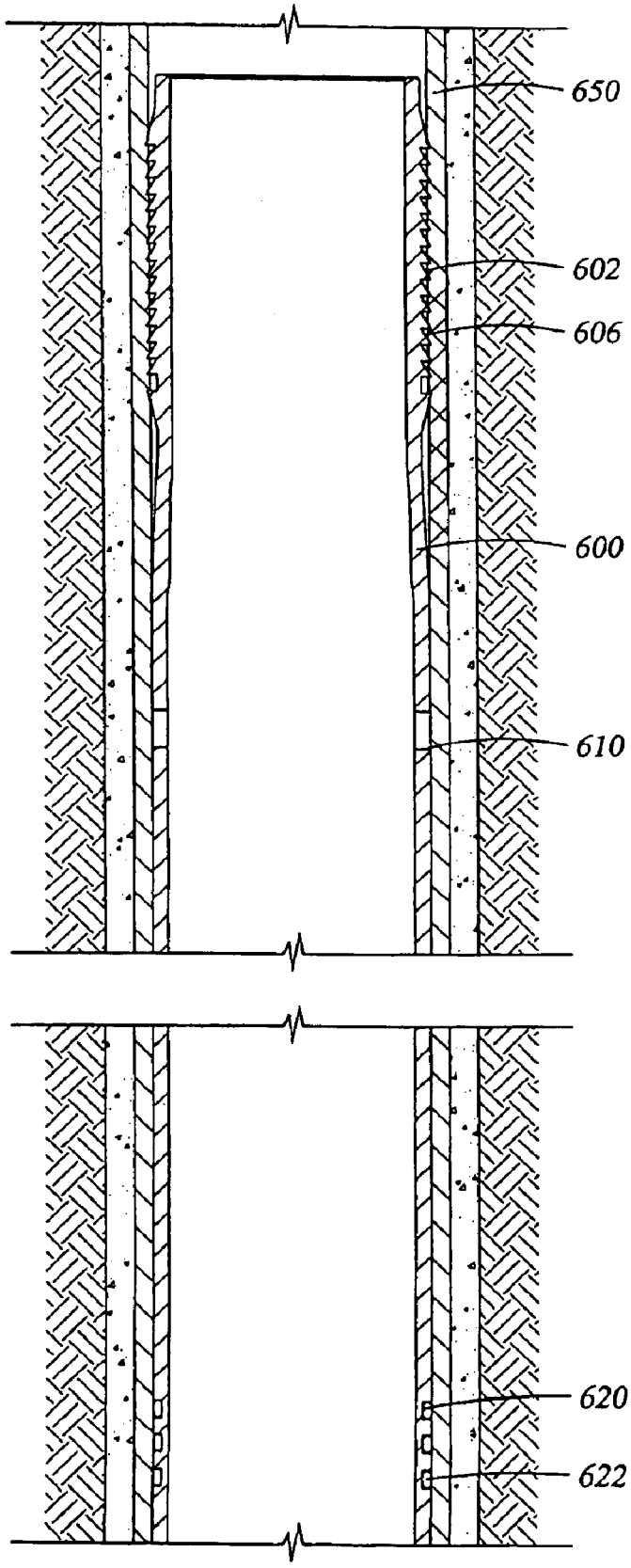
FIG. 20 is a section view of the tubular of FIG. 18 completely expanded into the larger diameter tubular therearound.

FIG. 20 is a section view of the smaller 600 and larger 650 diameter tubulars. As illustrated in FIG. 20, that portion of the smaller diameter tubular 600 including sealing grooves 620 with their rings 622 of elastomeric material have been expanded into the larger diameter tubular 650. The result is a smaller diameter tubular 600 which is joined by expansion to a larger diameter tubular 650 therearound with a sealed connection therebetween. While the tubulars 600, 650 are sealed by utilizing grooves and eleastomeric rings in the embodiment shown, any material could be used between the tubulars to facilitate sealing. In fact, the two tubulars could simply be expanded together to effect a fluid-tight seal.

In operation, a tubular string having the features shown in FIG. 18 at an upper end thereof would be used as follows: The tubular string 601 would be lowered into a wellbore until the circumferential area 602 of an upper portion 600 thereof is adjacent that area where the smaller diameter tubular 600 is to be expanded into a larger diameter tubular 650 therearound. Thereafter, using an expansion tool as described herein, that portion of the smaller diameter tubular 600 including area 602 is expanded into frictional contact with the tubular 650 therearound. With the weight of the tubular string 601 supported by the outer tubular 650, any fluid can be circulated through an annular area defined between the tubulars 600, 650 or between the outside of the smaller tubular and a borehole therearound. As fluid passes through the annular area, circulation is possible due to the apertures 610 in the wall of the smaller diameter tubular 600. Once the circulation of cement is complete, but before the cement cures, that portion of the smaller diameter tubular 600 bearing the circumferential grooves 620 with elastomeric seal rings 622 is expanded. In this manner, a hanging means is created between a first smaller diameter tubular 600 and a second larger diameter tubular 650 whereby cement or any other fluid is easily circulated through the connection area after the smaller diameter tubular is supported by the outer larger diameter tubular but before a seal is made therebetween. Thereafter, the connection between the two tubulars is sealed and completed.

While foregoing is directed to the preferred embodiment of the present invention, other and further embodiments of the invention may be devised without departing from the basic scope thereof, and the scope thereof is determined by the claims that follow.

What is claimed is:

1. A tubular section for downhole expansion into a larger diameter tubular, the section comprising:

at least one groove formed on an outer surface thereof, the at least one groove having a decreased wall thickness of the tubular section in the location of the groove relative to adjacent portions of the tubular section, wherein the at least one groove is angled relative to a longitudinal axis of the tubular section.

2. A tubular section for downhole expansion into a larger diameter tubular, the section comprising:

at least one formation formed on an outer surface thereof, the formation increasing the wall thickness of the tubular section in the location of the formation and defining at least one area having an original wall thickness, wherein the at least one area is angled relative to a longitudinal axis of the tubular section.

3. The tubular section of claim 2, wherein as the tubular section is expanded with a radial force directed towards an inside surface thereof opposite the at least one formation, an outer surface of the formation frictionally contacts an inner surface of the larger diameter tubular.

4. The tubular section of claim 3, whereby, after the tubular section has been expanded in the area of the formation, a fluid path is provided through the at least one area.

5. The tubular section of claim 3, further including at least one circumferential sealing groove formed in the outer surface thereof, the sealing groove expandable into contact with the larger diameter tubular to effectively seal the annulus.

6. The tubular section of claim 5, wherein the at least one circumferential groove includes an elastomeric sealing ring disposed therein.

7. The tubular section of claim 1, wherein the at least one groove is spiral shaped.

8. The tubular section of claim 2, wherein the at least one formation is spiral shaped.

9. A method of joining two tubulars in a wellbore comprising:

disposing a smaller diameter tubular coaxially within a larger diameter tubular;

expanding the smaller diameter tubular in an area of at least two formations formed on an outer surface thereof, whereby the weight of the smaller diameter tubular is borne by the larger diameter tubular; and circulating fluid between the tubulars along angled areas defined between the formations.

10. The method of claim 9, further including:

expanding a second area of the smaller diameter tubular having at least one circumferential groove formed therearound with a sealing element therein, whereby an annular area defined between the two tubulars is sealed to the passage of fluid.

11. The method of claim 10, wherein, the fluid includes cement and the steps are completed before the cement cures.

12. A method of joining two tubulars in a wellbore comprising:

disposing a smaller diameter tubular coaxially within a larger diameter tubular;

expanding the smaller diameter tubular in an area of at least two formations formed on an outer surface thereof, whereby the weight of the smaller diameter tubular is borne by the larger diameter tubular;

circulating fluid between the tubulars along areas defined between the formations, wherein, the fluid includes cement and the steps are completed before the cement cures; and expanding a second area of the smaller diameter tubular having at least one circumferential groove formed therearound with a sealing element therein, whereby an annular area defined between the two tubulars is sealed to the passage of fluid.

13. An expandable tubular section for use in a larger diameter tubular, the section comprising:

a sealing section; and a griping section having at least one formation formed on an outer surface thereof, the formation increasing the wall thickness of the tubular section in the location of the formation and upon expansion thereof arranged to leave a fluid pathway along the tubular section prior to expansion of the sealing section.

14. The tubular section of claim 13, wherein the at least one formation is spiral shaped.

* * * * *